United States Patent [19]

Lazaro

[11] Patent Number: 4,749,461

[45] Date of Patent: Jun. 7, 1988

[54] ELECTROPLATING BARREL

[75] Inventor: Anton Lazaro, Niles, Ill.

[73] Assignee: Hardwood Line Manufacturing Co., Chicago, Ill.

[21] Appl. No.: 77,197

[22] Filed: Jul. 24, 1987

[51] Int. Cl.[4] ..... C25D 17/20

[52] U.S. Cl. ..... 204/213

[58] Field of Search ..... 204/213

[56] References Cited

U.S. PATENT DOCUMENTS 3,421,993 1/1969 Lazaro ..... 204/213

*Primary Examiner*—T. M. Tufariello

*Attorney, Agent, or Firm*—Irwin C. Alter

[57] ABSTRACT

The invention disclosed is a perforated paddle wheel electroplating barrel divided into a number of spaced apart longitudinal chambers, each chamber having a flexible chain type cathodic contacts in electrical contact with a tubular conductor tube which rotates with the barrel, said conductor tube rotatably and electrically contacts a pair of conductor arms that are connected to an appropriate source of current.

3 Claims, 1 Drawing Sheet

ELECTROPLATING BARREL

BACKGROUND OF THE INVENTION

This invention relates to an appartus for electroplating, and more particularly to an apparatus of the type in which a plurality of different articles may be placed in a container and immersed in a plating solution while the container is rotated to accomplish plating without commingling the articles.

This is an improvement over my previous patent entitled "Electroplating Barrel", which issued as U.S. Pat. No. 3,421,993 on Jan. 14, 1969.

Paddle wheel barrels of the type described herein are presently known and are used for plating different type articles within a single barrel-type device so that comingling of articles is avoided. Thus, where small articles are to be plated with a paddle wheel barrel, sorting of the articles is not necessary.

My invention is an improved paddle wheel barrel that includes a new electrical system and construction that can be easily replaced and maintained and it is more efficient in operation as compared to previous systems.

It is an important feature of the invention to provide a paddle wheel electroplating barrel that has an electrical system that can be easily connected and not only can current be fed from both sides of the barrel but also the barrel has a system which has been simplified for ease of replacement, and also more efficient electrical contact and electrical distribution can be achieved in a paddle wheel barrel in addition to providing simple and efficient means of maintenance and replacement of components.

It is therefore an object of this invention to provide a new and improved paddle wheel which can plate several different types of articles without commingling the articles with a replaceable and more efficient electrical system that includes a single central cathode contact member that is insulated from the chambers and has electrical contact therewith by means of contacting elements associated with each chamber whereby the central cathode contacting member as well as the contacting members can be easily replaced.

In order to provide an efficient system, it is a special feature of this invention to provide current conducting arms that are made of copper and encapsulated from the electroplating solution as well as being shaped to cooperate with the electrical system by being sized to be received by an encapsulating tube which in turn fits into and is received in electrical contact with the inside of the central cathode contacting member.

Other and further objects, advantages and features of my invention will become more readily apparent in the following description and accompanying drawings wherein similar characters or reference indicate similar parts throughout the several views.

DESCRIPTION OF THE DRAWINGS

Referring to the drawings.

DETAILED DESCRIPTION OF THE INVENTION

Figure 2:
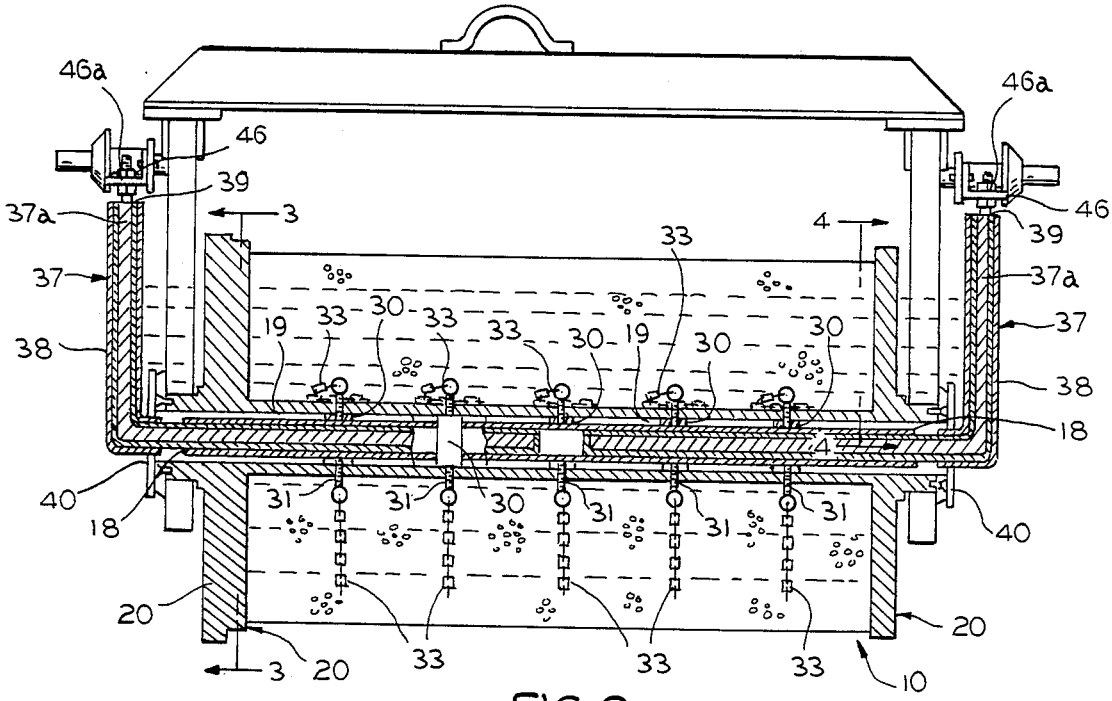
FIG. 2 is a sectional view taken along the plane passing through line 2—2 and looking in the direction of the arrows.

Referring generally to the figures in the drawing, a paddle wheel electroplating barrel 10 is shown that can be associated with a series of gears and a motor (not shown) to drive the barrel much in the same manner as the electroplating barrel illustrated in U.S. Pat. No. 3,421,993.

The barrel 10 is multi-chambered and has a plurality of radial partitions 13 having circulating openings extending longitudinally along the barrel. The paddle wheel barrel 10 is prefereably shown as having three chambers of equal size and shape that are formed by the radially extending partitions 13 having apex angles $\theta$ therebetween to define the radially extending chambers therebetween. The chambers have an apex at the inner ends of the partitions that is in the form of a plastic, hollow rod 26 with radially extending slots 26a that is electrically inert. The chambers have gradually increasing volumes at the outer ends of the partitions in accordance with the apex angles $\theta$ formed between the partitions 13. The paddle wheel barrel, by definition, has open spaces $\phi$ formed between the chambers that enables an optimum of circulation of plating solution as seen from FIGS. 1 and 3.

A central cathode connecting member 18, preferably made of stainless steel tubing, extends longitudinally along a cylindrical opening 19 on the inside of the barrel 10 at the center of the barrel or at the apex of the radially extending chambers A, B and C and has electrical contact with each of the radially extending chambers in order that parts disposed in each of the chambers can be plated therewith. Removable door means 22 are associated with the outer ends of the radially extending partitions by removable clamps 24 to enable parts to be conveniently deposited and withdrawn from each of the chambers without commingling the parts.

Figure 1:
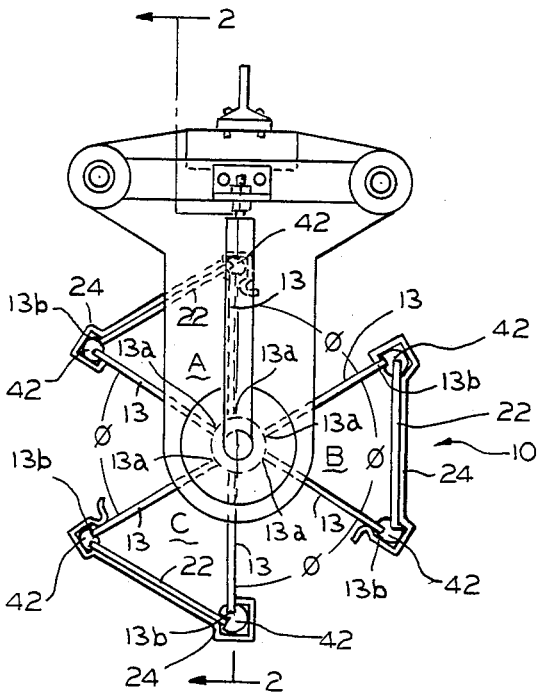
FIG. 1 is a front elevational view showing the transverse sections of the paddle wheel as defining three separate chambers that are triangular in cross-section.

Referring more specifically to FIG. 1, the improved paddle wheel electroplating barrel 10 may be made of a chemically inert material such as polypropylene plastic.

From FIG. 1 it can be seen that the paddle wheel barrel 10 is shown as having three separate chambers A, B, and C that extend longitudinally from one end of the barrel to the other end of the barrel and are affixed in the slots 21 of the polygonal shaped end plates 20, **20*a* that are in opposing relationship as shown in FIG. 2**.

Figure 3:
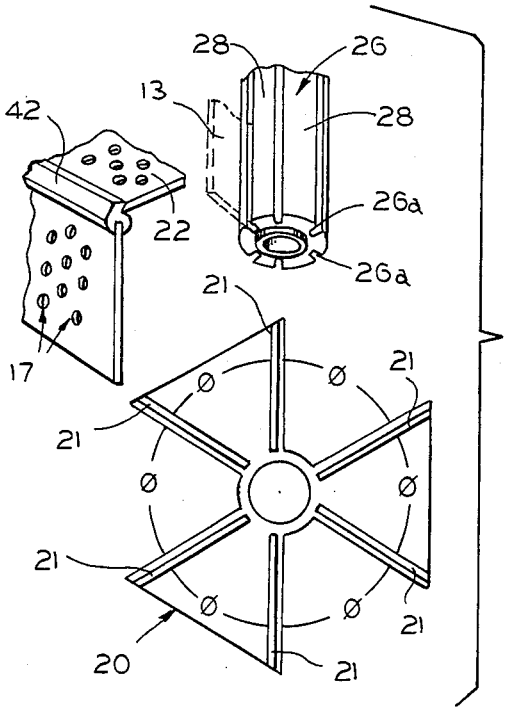
FIG. 3 is a partial sectional view taken along the line 3—3 of FIG. 2 and looking in the direction of the arrows.

As further seen from FIG. 3, the radially extending partitions 13 interlock in the slots 21 of the end plates 20, **20*a* and extend longitudinally along the barrel 10 and are positioned with an apex angle $\theta$ defining the angle between the radially extending chambers as well as the open spaces between the chambers. The partitions 13 have an inner end 13*a* and an outer end 13*b*; and the chambers have the apex at their inner ends that are made up of the central rod 26 that has the radial slots 26*a*** to position the partitions so that they are disposed to form gradually increasing volumes in accordance with the apex angles $\theta$ between the partitions.

Since the radial slots **26*a* of the cental rod 26 extend longitudinally along the barrel, they form ribs 28 therebetween that are contiguous with and interposed between each of the inner ends 13***a* of the radially extending partitions 13 at the apex of the radially extending chambers: A, B, and C. FIG. 3 shows a radially extending partitions 13, in phantom, held by one of the slots 26*a*.

The central cathode 18 is a corrosion-resistant tubular member preferably made of stainless steel that extends longitudinally along the central cylindrical opening 19 of the barrel and makes electrical contact with the plating solution by means of circular rings 30 that have screw fasteners 31 that are attached to contacting means such as chains 33 extending into the solution, as seen in FIG. 2.

Figure 4:
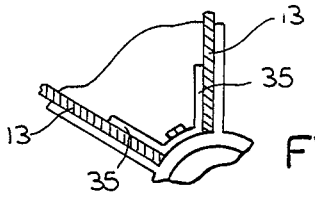
FIG. 4 is a partial broken away cross-sectional view taken on a plane passing through the line 4—4 in FIG. 2 to show another type of cathode contacting member that can be used as an alternate to the chain members.

As seen from FIG. 2, the rings 30 are interposed between the central cathode 18 and the inner periphery of the central member so that the rings are wrapped around the central cathode 18 in electrical contact and can feed current to the chain members 33 and screws 31. The screws can also be used to removably fasten other types of contacting members in place of the chains such as, for instance, the plate contacting members 35, as shown in FIG. 4.

As seen from FIG. 2, the electrical power is delivered to the electroplating barrel by means of L-shaped members 37 with a copper cores 37*a* that are surrounded by corrosion-resistant conductor sleeves 39 that can be preferably made of stainless steel.

As seen in FIG. 2, the L-shaped members 37 have one end that extends from brackets 46 by being removably attached thereto by tension adjusting nuts 46*a* at each end of the barrel. Each L-shaped member extends downward from each bracket and thereafter protrudes through the central cathode member 18 to make electrical contact with the inner periphery thereof. As seen from FIG. 2, each of the L-shaped members is preferably encapsulated with a rubber insulation 38 at the portion that is outside the cylindrical opening 19 of the barrel. Donut-shaped sealing plates 40 are shown in FIG. 2 and are shown forming a seal between the rubber sleeve and the outside of the barrel that is exposed to plating solution when plating. As seen from FIGS. 1 and 3, the strips 42 are attached to and extend along each of the outer ends 13*b* of the radially extending partitions 13. The strips 42 are formed to receive each of the door members so that the flexible locking members may be used to lock the doors in place by removably gripping the strips while the removable doors are in place as seen in FIG. 1.

Since electroplating barrels are well-known, various details have been represented generally in the drawing. Generally, a cathode power source can be connected to the fasteners and electrical energy is furnished to the L-shaped members 37 by an outside source (not shown). Thus, electrical energy can be transmitted to the barrel by going through the copper cores 37*a* of the L-shaped members 37, the stainless steel sleeves thereof, the circular collector rings, the screw fasteners which are in turn connected to the chain-type cathodes whereby the cathode chains can be energized to cause electroplating.

To assemble barrel 10, the radially extending partitions 13 are attached to the opposing end plates with the slots 21 in the ends plates as well as the radial slots 26*a* of the central rod 26. After this is done, the central cathode 18 is inserted in the cylindrical opening with the circular collector rings 30 disposed in place so that the screw fasteners and chains can be attached thereto as shown in FIG. 2. Thereafter, the L-shaped members have one end thereof attached to the adjusting nuts and the other end thereof of each one is slid into place on the inner periphery of the central cathode member 18 in electrical contact therewith. The donut-shaped sealing plates 40 are positioned for sealing the barrel once the L-shaped members are in place. Thereafter, the barrel are loaded with parts and the removable door means are associated with the outer ends 13*a* of the radially extending partitions 13 to form the radially extending chambers A, B and C.

The operation of the electroplating apparatus being substantially like former barrel-type electroplating apparatus disclosed in my previous U.S. Pat. No. 3,421,993, is affected by immersing a barrel in a tank containing electroplating solution. Thereafter, a motor rotatably drives the barrel at a slow speed in a certain direction. Due to the polygonal nature of each of the chambers A, B and C of the barrel, the articles to be electroplated will be caused to tumble over and over in the solution while they are in electrical contact with the contact means. During this time, the electroplating solution freely circulates through the barrel by means of the perforations 17 and the wall means 13 and the door means and the parts to be electroplated do not escape from each of the chambers. As the barrel 10 is rotating, the inner periphery of the conductor tube which remains stationary, makes sliding contact with the L-shaped members 37 and in turn transmits electrical energy therefrom to the fastener screws 31 and chains 33.

With this type of electroplating barrel, one part of the barrel can be replaced very quickly and selectively since the barrel is modular. For instance, if the radially extending plates 13 are worn, they can be removed and replaced by merely taking them out of the grooves 21 of the end plates 20 and radial slots 26*a* of the central rod 26. Also, the construction of the L-shaped members facilitates their replacement because of the convenient tension adjusting nuts 46a that are used to attach them to the barrel at the brackets 46 on the barrel. Further, it should be realized that it is contemplated that the new and improved barrel 10 can make electrical connection with the parts in a solution in various well-known ways in addition to the chain contacts. Thus, while I have illustrated a preferred embodiment with the chain contacts as well as another embodiment having plates connected to the barrel. I do not wish to be limited to the precise features of the construction set forth but desire to avail myself of all changes within the scope of the appended claims.

What is claimed is:

1. An electrical plating barrel having a rotatably driven barrel with a pair of end plates, a central cathode contacting member extending longitudinally within said barrel substantially at the center thereof, said central contacting member including:

a hollow longitudinal cylindrical conductor tube that is rigidly associated with a barrel so as not to have any relative motion with the barrel or the central cathode connector, a pair of L-shaped conductor tubes rotatably mounted within said hollow, longitudinal, cylindrical conductor tube, said pair of conductor tubes each having one of each of their ends protruding through a respective end plate and extending to a cathode power source.

said pair of conductor tubes being mounted with respect to said electrical apparatus to remain stationary while said hollow, cylindrical conductor rotates with said barrel, said conductor tubes being suitably sized for having the periphery thereof make rotatable sliding contact with the inner periphery of said hollow longitudinal cylindrical conductor tube, said barrel having a paddle wheel construction with radially extending partitions whereby barrel components are formed between open spaces that are defined between each of said barrel compartments, and contacting members operatively associated with each barrel compartments of said paddle wheel barrel and electrically connected to said conductor tube, whereby electrical current is transmitted to each of said barrel compartments by means of said longitudinal cylindrical conductor tube and contact means while said barrel is rotating.

2. An electroplating apparatus as defined in claim 1 wherein said L-shaped conductor tubes include a copper core that is encapsulated and is encased in corrosion-resistant stainless steel that makes rotating and electrical contact with the inner periphery of said central cathode conductor tube, said L-shaped conductors being encapsulated with an insulator at the point where they extend outside of said barrel.

3. An electroplating apparatus as defined in claim 2, wherein there is a central rod having radial slots defined therein for receiving said radially extending partitions longitudinally along said barrel to define radially extending chambers therebetween having certain said apex angles and certain spaces therebetween that are also radially extending and also have their own angles, said radially extending partitions being held in position by said radially extending slots that extend longitudinally and are attached at each end to a pair of slotted end plates that receive opposite sides of said radially extending partitions at each end of said barrel, said barrel having inner and outer ends that are received by slotted members, said chambers having an apex at the inner end of said partitions and having gradually increasing volume at the outer ends of said partitions, said partitions being posiitoned and held there by said grooves in said end plates and said radially extending slots as well, whereby said barrel can be repaired by removing and replacing various components on a modular basis due to the various slot constructions formed in the parts thereof to hold said components.

* * * * *

UNITED STATES PATENT AND TRADEMARK OFFICE

CERTIFICATE OF CORRECTION

PATENT NO. : 4,749,461
DATED : June 7, 1988
INVENTOR(S) : Anton Lazaro

It is certified that error appears in the above-identified patent and that said Letters Patent are hereby corrected as shown below:

| | |
|---|---|
| Col. 1, line 58 | "or", should be --of--. |
| Col. 2, line 18 | "circulating", should be --circulation-- |
| Col. 2, line 20 | "prefereably" should be --preferably--. |
| Col. 4, line 6 | "barrel", should be --barrels--. |
| Col. 5, line 13 | "compartments", should be --compartment--. |

Signed and Sealed this

First Day of November, 1988

*Attest:*

DONALD J. QUIGG

*Attesting Officer*

*Commissioner of Patents and Trademarks*